United States Patent [19]

Ellzey

[11] 4,082,273

[45] Apr. 4, 1978

[54] STRIKING IMPLEMENTS

[75] Inventor: James M. Ellzey, Narberth, Pa.

[73] Assignee: The Ellzey Company, Radnor, Pa.

[21] Appl. No.: 659,384

[22] Filed: Feb. 19, 1976

[51] Int. Cl.[2] ..... A63B 49/08

[52] U.S. Cl. ..... 273/73 J

[58] Field of Search ..... 273/67 D, 67 DA, 67 DB, 273/72 R, 73 R, 73 H, 73 J, 75, 78, 80.9, 81 R; 145/61 R, 61 M, 29 R

[56] References Cited

U.S. PATENT DOCUMENTS

| | | | |
|---|---|---|---|
| 729,639 | 6/1903 | McCoy | 273/72 R |
| 925,389 | 6/1909 | Royce | 273/78 |
| 1,111,314 | 9/1914 | Murphy | 273/72 R |
| 1,851,439 | 3/1932 | Mattern | 273/81 R |
| 3,633,910 | 1/1972 | Spenle | 273/73 C X |
| 3,941,380 | 3/1976 | Lacoste | 273/73 J X |

FOREIGN PATENT DOCUMENTS

| | | | |
|---|---|---|---|
| 828,452 | 2/1938 | France | 273/73 J |
| 1,418,094 | 10/1965 | France | 273/75 |
| 2,106,800 | 9/1971 | Germany | 273/73 J |
| 16,687 of | 1892 | United Kingdom | 273/67 DA |
| 17,450 of | 1900 | United Kingdom | 273/67 DA |
| 24,549 of | 1907 | United Kingdom | 273/67 DA |
| 6,480 of | 1909 | United Kingdom | 273/67 DA |
| 7,269 of | 1914 | United Kingdom | 273/73 J |
| 206,017 | 11/1923 | United Kingdom | 273/75 |

*Primary Examiner*—Richard J. Apley

*Attorney, Agent, or Firm*—Allen V. Hazeltine; Thomas M. Ferrill, Jr.

[57] ABSTRACT

A tennis racket or other striking implement for minimizing the shock imparted to the arm of the user, having a head or striking portion and a handle portion provided with a longitudinal slot lying in a plane substantially parallel to the striking face, said handle having a longitudinal hole in the end thereof remote from the striking head to accommodate an insert of resilient elastic material slightly larger than the hole diameter such as to produce spreading of the parts of the handle on either side of the slot when the insert is introduced into the hole, and a grip-enhancing binding on the handle applied in a manner to urge the two parts of the handle together and to compress the insert. Preferably the insert is of highly compressed rubber, but it may comprise natural or synthetic rubber. The invention may be applied to striking implements having handles made of wood as well as to those having tubular handles of metal, fiber glass or other materials.

9 Claims, 3 Drawing Figures

STRIKING IMPLEMENTS

Figures 1, 2, 3:
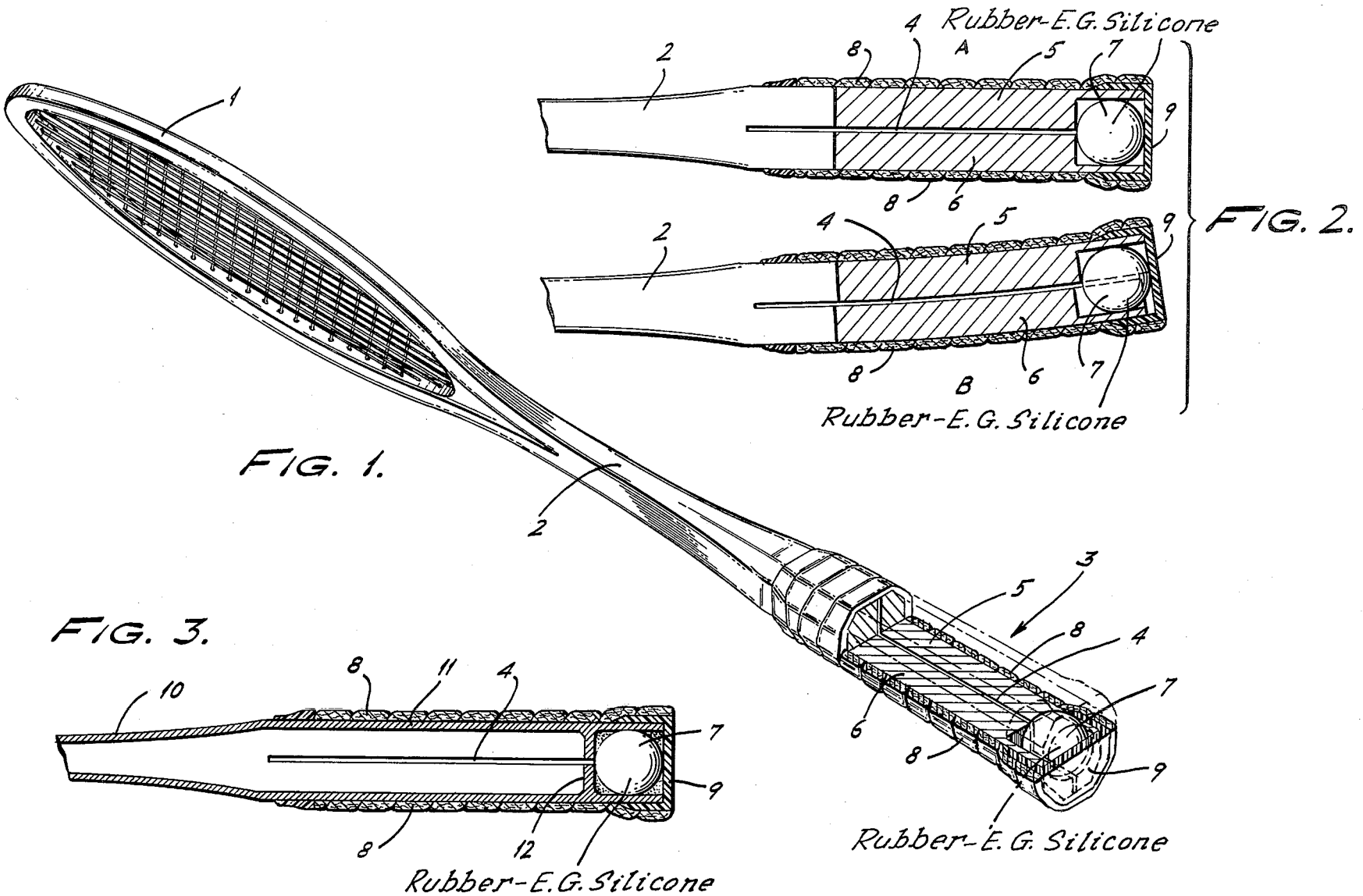

This invention relates to improvements in striking implements. While it was originally conceived for and is particularly adapted for use in tennis rackets, it also is well adapted for use with other striking implements such as hammers, mallets, baseball bats and the like.

As is well known, when a tennis ball is struck with a conventional tennis racket, a considerable shock is imparted to the arm of the player which causes discomfort and may even induce ailments such as that commonly referred to as "tennis elbow." Similar problems arise in the use of hammers, mallets, baseball bats and other striking implements wielded by the hand or hands of the user. Prior to the present invention, attempts have been made to solve these problems, for example by providing a layer of shock-absorbing material around the handle portion of a tennis racket or other striking implement, over which the usual grip-enhancing covering was applied. See, for example, West German Offenlegungsschrift No. 2,106,800 dated Sept. 2, 1971. Such attempts have proved unsatisfactory because the layer of shock-absorbing material underlying the grip-enhancing covering resulted in a grip which was lacking in firmness and which was therefore unsatisfactory when used in tennis rackets, for example, because the racket tended to turn slightly in the hand of the player when a ball was struck slightly off center of the face of the racket head so that the direction in which the ball was hit could not be precisely controlled. The present invention is directed to improvements for overcoming these difficulties, and, in addition, to improving the effectiveness of such striking implements for their intended purpose.

Accordingly, it is the object of the invention to provide an improvement in striking implements for minimizing shock imparted to the arm of a user and for improving the effectiveness of such implements.

A particular object of the invention is to provide an improved tennis racket for minimizing shock imparted to the arm of a user, which thereby minimizes the likelihood of physical injury to the user resulting from such shock, and the effectiveness of which is improved by reason of the fact that use of the invention renders it feasible to string the racket with greater tension so as to improve its playing characteristics, which heretofore has not been feasible because, when this was done with a conventional racket, it tended to produce undue shock in the arm of the user.

In accordance with the invention, these objectives may be achieved by modifying a conventional striking implement, such as a tennis racket, having a head or striking portion adapted to engage an object to be struck and an elongated handle affixed to said head portion having an axis substantially parallel to said striking face. Such modification consists in boring a longitudinal hole in the end of the handle remote from the striking head and extending a short distance into the handle so as to accommodate an insert of resilient elastic material, which may be in the form of a ball or a short cylinder. A longitudinal slot is then made in the handle in a plane substantially parallel to that of the striking face, extending at least part of the length of the handle from the end thereof farthest from the striking head and laterally through the handle so as to divide the handle into two parts. The insert, which should be of a diameter slightly greater than that of the hole, is then forced into the hole and effects a slight spreading of the parts of the handle on either side of the longitudinal slot. The portion of the handle near the end thereof is then wrapped with a suitable tape or other material in such manner as to urge the two parts of the handle together and to compress the insert slightly. This wrapping may take the form of the conventional leather or synthetic wrapping ordinarily used in forming the grip on the handle of a conventional tennis racket.

From actual use of tennis rackets made in this manner I have found that the shock imparted to the arm of the user is greatly reduced, to such an extent that, since using a tennis racket of this construction I have experienced no difficulty with tennis elbow or other arm discomforts. This has been confirmed by others who have used such rackets. The reason for this will be explained more fully hereinafter. Also I have found that in a racket of this construction, the tension of the stringing of the head portion can be increased from tensions of the order of from 55 to 57 pounds, which have customarily been used with conventional rackets, to tensions as high as 62 pounds or greater without the accompanying uncomfortable or injurious increase in the shock effect on the arm of a user which has been found to occur when the stringing tension of a conventional racket is increased. Furthermore I have found that this capability of increasing the stringing tension without increasing the shock effect provides a racket, the playing performance characteristics of which far exceed those of conventional rackets, particularly in that much greater impact may be exerted on the tennis ball and the "feel" of the racket to the player is greatly improved. This likewise has been confirmed by others who have used rackets constructed in accordance with the present invention.

The invention will be fully understood from consideration of the following description thereof with reference to the accompanying drawings in which:

FIG. 1 is a perspective view, partially in section, showing a conventional tennis racket modified to embody the invention, FIG. 2 is a fragmentary sectional view of the handle of a tennis racket embodying the invention showing the action which occurs therein when a ball is struck, and FIG. 3 is a fragmentary sectional view showing a tubular tennis racket handle, which may be of metal of fiber glass, for example, embodying the invention.

Referring to FIG. 1, there is shown a conventional tennis racket comprising a head portion 1, which is strung with gut or synthetic material in the usual manner, and a handle portion 2. Both the frame of the head portion 1 and the handle 2 may be wood, although that is not essential to the practice of the invention, as will be explained later. The grip portion 3 of the handle, which is modified in accordance with the invention, is shown partially cut away and in section in order better to illustrate the features in accordance with the invention. Specifically, in accordance with the invention, a slot or kerf 4 is cut in the grip portion 3 of the handle lying in a plane substantially parallel to the plane of the head portion 1 of the racket—i.e., in a plane substantially normal to the direction in which the head 1 of the racket moves when it is swung to strike a tennis ball. The slot or kerf 4 typically may be one-eighth inch in thickness, although this dimension is not critical, and as shown it extends longitudinally from the butt end of the handle 2 the entire length of the grip portion 3 and laterally through the handle so as to divide or bifurcate the grip portion into two parts 5 and 6. Although shown as being coextensive in length with the grip portion 3, the slot 4 may extend from the butt portion of the handle 2 less than the full length of the grip portion 3, or alternatively it may extend beyond the grip portion 3 a distance along handle 2 toward the striking head 1. In practice I have found that satisfactory results are obtained when the slot extends only throughout the length of the grip portion 3.

Further in accordance with the invention, in the butt end of the handle 2 a hole is drilled coaxial with the axis of handle 2 and at least deep enough to accommodate an insert 7 of resilient elastic material. As shown in FIG. 1 insert 7 may take the form of a ball of compressed rubber—i.e., rubber molded in the form of a ball under pressure of the order of 25,000 pounds per square inch. Typically, in a conventional wood tennis racket the ball insert 7 may be of a diameter from 13/16 to ½ inch, and the diameter of the hole in the butt end of the racket handle 2 is drilled to a diameter somewhat less than the diameter of the ball insert 7 — e.g., ¾ inch in the case of a 13/16 diameter insert — and to a depth approximately equal to the diameter of the insert. In some tennis rackets which I have modified in accordance with the invention I have used an insert made by cutting down to a diameter of approximately 13/16 inch a 1 inch diameter ball of compressed rubber which is widely sold commercially under the registered trademark SUPER-BALL.

When the handle of the racket has been prepared in the manner described above by drilling and slotting it, the ball insert 7 is forced into the undersize hole in the butt end of handle 2, which will cause the parts 5 and 6 of the handle to be slightly spread apart. Following this, a conventional grip-enhancing wrapping 8 of leather or plastic is applied to the exterior of grip portion 3 in a manner to urge the two parts 5 and 6 of the split handle toward each other so as slightly to compress the ball insert 7. The usual cap 9 of plastic or other suitable material may be slipped over the end of the grip portion 3 before this covering 8 is applied.

I have found that a tennis racket constructed in the manner above described is effective very substantially to reduce the shock imparted to the arm of the user of the racket, thereby greatly enhancing the comfort and pleasure of the tennis player and, as has been observed in a number of instances, eliminating the incidence of "tennis elbow." While I do not wish to be bound by an explanation of why this improvement occurs, I believe that it is due to the fact that when a ball is struck with a racket embodying the invention, the bending which takes place in the slotted portion of the handle causes the two halves of the handle on either side of the slot to move slightly longitudinally relative to each other against the resistance afforded by friction between the ball insert 7 and the sides of the hole in the butt end of the handle. I believe that this action tends to damp vibrations set up in the racket handle when a ball is struck, thereby reducing the shock imparted to the arm of the user. This action is illustrated in FIG. 2, where at A is shown in cross-section the grip portion 3 of the racket embodying the invention in its normal position before a ball is struck with the racket. In the lower portion of FIG. 2 at B is shown, somewhat exaggerated, the deflection produced in the grip portion 3 of the handle when a ball is struck with the racket. As will be seen, by reason of the flexing of the grip portion of the handle the two portions 5 and 6 on either side of slot 4 will be displaced longitudinally relative to each other so that, at the butt end of the grip portion 3, the ends thereof will be relatively displaced with respect to each other and the sides of the hole in the butt end on either side of slot 4 will move relative to the ball insert 7. Since the two halves 5 and 6 of the grip portion are pressed against the ball by the grip-enhancing winding, substantial friction will exist between the ball insert 7 and the two sides of the hole which will tend to cause damping of oscillations induced in the handle when the ball is struck.

While as shown and described with reference to FIGS. 1 and 2, the insert 7 is in the form of a ball inserted in a hole of depth approximately equal to the ball diameter, other forms of inserts—e.g., cylindrical inserts of circular or polygonal cross-section—may be used and the insert may be inserted in a hole extending longitudinally over a greater fraction of or the entire length of the grip portion 3 of the racket handle. Furthermore, while specific reference has been made to the use of an insert of compressed rubber, it should be understood that many other elastic and resilient materials may be used, including natural and synthetic rubbers, such as silicone rubber. One example of such materials which has been tried and found suitable is RTV-11 silicone rubber manufactured and sold by the General Electric Company, which is available as a two part mix. In using a material of this sort, I have found it convenient to follow a slightly different procedure in making the racket handle in accordance with the invention. Specifically, after the handle has been slotted and drilled in the manner described above, the two halves of the handle are forced slightly apart by the insertion of wedges, a temporary wrapping of masking tape may be applied around the handle to seal off the slots, and the mix is poured into the hole in the handle and permitted to cure, following which the wedges are removed and the grip-enchancing binding is applied to urge the two halves of the handle toward each other against the resistance of the insert.

While the invention has been described herein with particular reference to its application to a wooden racket handle, it is equally applicable to handles made of other materials such as metal or fiber glass and the like, which may be tubular in form. The application of the invention to such a handle is illustrated in FIG. 3, in which is shown a portion of a tubular handle 10 of metal or fiber glass having a tubular grip portion 11. In applying the principles of the invention to such a handle slots 4 are cut in opposing walls of the grip portion 11 and there may be provided an internal wall or barrier 12 fixed inside the tubular grip portion to confine the insert 7 in its desired location near the butt end of the grip portion. This wall or barrier 12 may also be provided with a transverse slot extending across its diameter between the longitudinal slots 4 on opposite sides of the grip portion 11. It may be desirable to roughen the inner surface of the handle in the vicinity of the insert 7 by etching or otherwise to increase friction between the insert and the handle to improve damping. The grip-enhancing covering 8 may be applied in the same manner as described above to urge the two halves of the grip portion toward each other to compress the insert 7. The action of a tubular handle so constructed will be essentially the same as that hereinbefore described with reference to a wooden handle and will yield similar results with respect to reduction of shock imparted to the arm of the user.

It should be emphasized that in the construction of a tennis racket handle embodying the invention, the slot in the handle should lie in a plane which is essentially the same as, or which is essentially parallel to, the plane of the striking surface of the racket so that the desired flexing and damping action will be a maximum.

While the invention has been particularly described with reference to its application to tennis rackets, it will be appreciated that it also may be applied to other striking implements such as hammers, mallets, baseball bats and the like where similar shock problems arise, and that similar advantages will accrue for essentially the same reasons as hereinbefore set forth. In applying the invention to any such striking implement, it should be borne in mind that, to achieve optimum advantages in accordance with the invention, the slot in the handle of the striking implement should be made so that it lies in a plane substantially parallel to the plane of the striking face of the implement. Thus, in a hammer, this slot should be parallel to the striking face of the hammer head.

As will be apparent from the foregoing description, the invention makes possible the construction of an improved striking implement, such as a tennis racket, for minimizing shock imparted to the arm or arms of the user, while at the same time affording a firm grip on the handle thereof so that the implement does not tend to twist in the hand of the user when an object is struck, and which also makes it possible to enhance the effectiveness of the implement by increasing the force which may be exerted in using it.

While the invention has been described with reference to certain preferred embodiments thereof, it will be understood that various modifications may be made without departing from the scope of the invention as defined by the following claims.

I claim:

1. A tennis racket incorporating means for minimizing shock imparted to the arm of a user, comprising:

(a) a head portion, (b) an elongated handle affixed to said head portion and including a gripping portion near the end thereof remote from said head portion, said handle consisting of a single longitudinal slot therein lying in a plane substantially parallel to that of said head portion, extending part of the length of said handle from the end thereof farthest from said head and laterally through said handle so as to divide said handle into two unitary parts and so as to permit longitudinal movement of said parts relative to each other, and said gripping portion having a longitudinal hole in the distal end thereof remote from said head portion and extending a part of the length of said gripping portion, said hole being of substantially uniform cross section throughout its length, wherein its length is substantially the same as the length of an object inserted therein, and having bounding surfaces substantially free from obstructions so that an object inserted therein is free to move in relation to said surfaces subject only to frictional forces exerted between said surfaces and said object whenever longitudinal movement between said parts of said handle occurs when an object is struck with said racket, (c) an insert of resilient elastic material contained in said hole, said insert having a dimension transverse to the longitudinal axis of said handle which is somewhat larger than the transverse dimension of said hole prior to insertion thereof, such as to spread the parts of said handle upon insertion, and (d) a grip-enhancing binding applied to the exterior of said gripping portion in a manner to urge the parts of said handle toward each other and to compress said insert.

2. A striking implement incorporating means for minimizing shock imparted to the arm of a user, comprising:

(a) a head portion having a striking face adapted to engage an object to be struck, (b) an elongated handle affixed to said head portion and having an axis substantially parallel to said striking face, said handle consisting of a single longitudinal slot therein lying in a plane substantially parallel to the plane of said striking face, extending at least part of the length of said handle from the end thereof farthest from said head portion and laterally through said handle so as to divide said handle into two unitary parts and so as to permit longitudinal movement of said parts relative to each other, and said handle having a longitudinal hole in the distal end thereof remote from said head portion and extending part of the length of said handle, said hole being of substantially uniform cross section throughout its length, wherein its length is substantially the same as the length of an object inserted therein, and having bounding surfaces substantially free from obstructions so that an object inserted therein is free to move in relation to said surfaces subject only to frictional forces exerted between said surfaces and said object whenever longitudinal movement between said parts of said handle occurs when an object is struck with said implement, (c) an insert of resilient elastic material contained in said hole, said insert having a dimension transverse to the longitudinal axis of said handle which is somewhat larger than the transverse dimension of said hole prior to insertion thereof, such as to spread the parts of said handle upon insertion, and (d) a grip-enhancing binding applied to the exterior of said handle near the end thereof farthest from said head portion in a manner to urge the parts of said handle toward each other and to compress said insert.

3. A striking implement according to claim 2 in which said insert comprises compressed rubber.

4. A striking implement according to claim 2 in which said slot is substantially coextensive in length with said gripping portion of said handle.

5. A striking implement according to claim 2 in which the depth of said hole is substantially the same as the length of said insert so that the insert contacts both the side and the bottom of said hole.

6. A striking implement according to claim 2 in which said insert comprises a ball of resilient elastic material.

7. A striking implement according to claim 2 in which said handle is tubular and is provided with a circular interior barrier defining a hole to receive said insert.

8. A striking implement according to claim 7 in which the internal surface of said tubular handle is roughened in the region occupied by said insert to increase friction between said insert and the parts of said handle on either side of said slot.

9. A striking implement according to claim 2 in which said insert comprises silicone rubber.

* * * * *